United States Patent [19]

Obata et al.

[11] 4,327,700

[45] May 4, 1982

[54] EXHAUST GAS RECIRCULATION SYSTEM FOR INTERNAL COMBUSTION ENGINES

[75] Inventors: Masatoshi Obata; Norio Satoh, both of Wako, Japan

[73] Assignee: Honda Giken Kogyo Kabushiki Kaisha, Tokyo, Japan

[21] Appl. No.: 175,669

[22] Filed: Aug. 5, 1980

[30] Foreign Application Priority Data

Aug. 11, 1979 [JP] Japan ..... 54-101800

[51] Int. Cl.[3] ..... F02M 25/06

[52] U.S. Cl. ..... 123/571

[58] Field of Search ..... 123/571, 569, 568

[56] References Cited

U.S. PATENT DOCUMENTS

| | | | |
|---|---|---|---|
| 3,884,200 | 5/1975 | Caldwell . | |
| 4,033,308 | 7/1977 | Hayashi et al. . | |
| 4,050,429 | 9/1977 | Yasuhiro et al. . | |
| 4,171,691 | 10/1979 | Nohira et al. | 123/571 |
| 4,180,033 | 12/1979 | Aoyama . | |
| 4,187,811 | 2/1980 | Katoh et al. . | |
| 4,274,385 | 6/1981 | Yuzawa et al. | 123/571 |
| 4,290,404 | 9/1981 | Hata et al. | 123/571 |

FOREIGN PATENT DOCUMENTS

| | | | |
|---|---|---|---|
| 53-71724 | 6/1978 | Japan | 123/571 |
| 1486093 | 9/1977 | United Kingdom . | |
| 1486651 | 9/1977 | United Kingdom . | |

*Primary Examiner*—Wendell E. Burns
*Attorney, Agent, or Firm*—Lyon & Lyon

[57] ABSTRACT

An exhaust gas recirculation system for an internal combustion engine employs a vacuum actuator for a control valve in the exhaust gas recirculation passageway. A suction conduit to the actuator contains a magnetic valve for venting the suction conduit to atmosphere. The operating means for the magnetic valve includes a vacuum switch responsive to suction pressure in the engine intake passage modified by atmosphere pressure compensation means. A second magnetic valve responsive to engine speed also vents the suction conduit to atmosphere.

3 Claims, 1 Drawing Figure

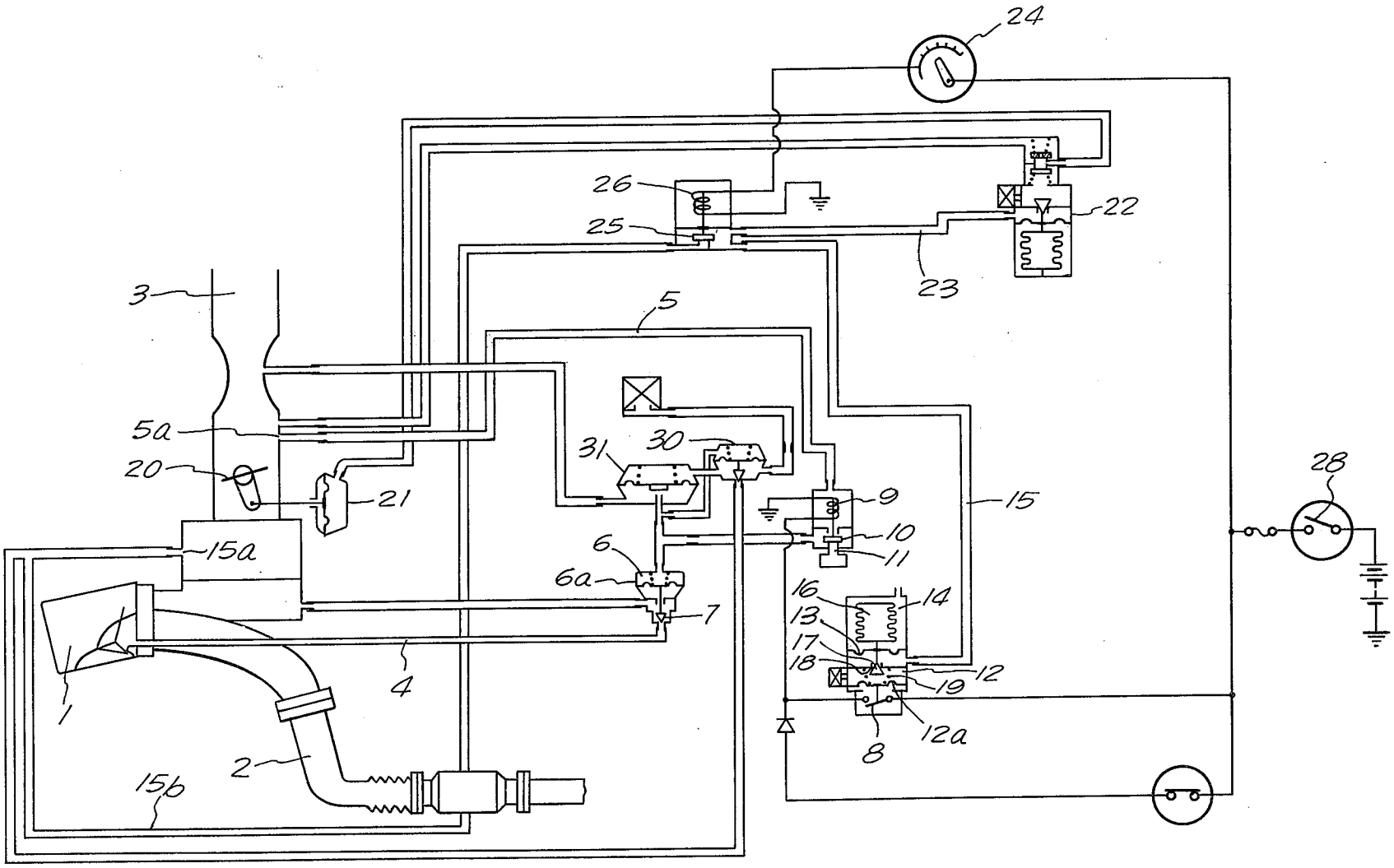
28
24
22
23
15
12
19
12a
14
8
9
10
11
16
13
17
18
26
25
5
30
31
7
6
6a
21
4
2
3
5a
20
15a
15b
1

EXHAUST GAS RECIRCULATION SYSTEM FOR INTERNAL COMBUSTION ENGINES

This invention relates to an exhaust gas recirculation system for use with an internal combustion engine for automobiles or the like.

In conventional exhaust gas recirculation systems of such type, there is provided an exhaust gas return passageway which communicates between the exhaust passage of the engine and the intake passage thereof. Provided in said return passageway is an exhaust gas recirculation control valve which operates in response to suction pressure in the intake passage. A suction conduit extends from the intake passage to the actuator for the recirculation control valve. A magnetic valve is provided in the suction conduit which opens to vent the suction conduit to atmosphere under certain engine operating conditions. For example, a suction pressure switch detects high vacuum pressure in the intake passage at the time of engine deceleration. Thus, when the engine speed decelerates, recirculation of the exhaust gas is interrupted in order to limit discharge pollutants into the atmosphere.

Other conventional systems are constructed so that when the atmospheric pressure drops, for example, when operating the engine at high elevation above sea level, recirculation of exhaust gas is also interrupted in order to avoid poor combustion in the engine.

The principal object of the present invention is to provide an exhaust gas recirculation system which meets both of the above-mentioned requirements. This object is attained by providing a magnetic valve in the vacuum conduit which valve will open to vent the conduit to atmosphere when a vacuum switch detects a high vacuum intensity within the intake passage at the time of deceleration in the engine speed. The switch, according to the present invention, is operated by a diaphragm which divides an atmospheric chamber from a suction chamber, the latter being in communication via a suction conduit with the intake passage. The suction conduit is provided with a suction pressure responsive valve which has a means for compensation of the atmospheric pressure.

According to a second aspect of the present invention, an exhaust gas recirculation system for use with internal combustion engines incorporates, in addition to the features of the previously described system according to the first aspect of the present invention, a control valve for a throttle opener. Accordingly, the present invention also provides an exhaust gas recirculation system as described above in which the intake passage communicates with an engine speed responsive magnetic valve at the downstream side thereof, the latter being provided with a throttle opener suction pressure conduit communicating with the throttle opener control valve.

Other and more detailed objects and advantages will appear hereinafter.

The drawing is a schematic diagram showing a preferred embodiment of this invention.

Referring to the drawing, the internal combustion engine generally designated 1 has the usual exhaust passage 2 and intake passage 3. An exhaust gas return conduit 4 is provided with a recirculation control valve 7 having a vacuum chamber 6 as a part of the vacuum actuator 6*a*. A suction conduit 5 extends from a port 5*a* provided in the intake passage 3 at a point slightly above the idle position of a throttle valve 20 and is provided with a magnetic valve 10 incorporating an actuating solenoid 9. When the vacuum switch 8 detects high suction pressure within the intake passage 3 during deceleration of the engine 1, the actuating solenoid 9 is energized to connect the suction conduit 5 to atmosphere through the port 11.

The vacuum switch 8 is provided with a vacuum actuator 12 which includes the diaphragm 12*a*. An atmospheric chamber 14 contains a closed bellows 16 connected to the valve 17 and the diaphragm 13. A spring 19 acts in the direction to open the vacuum switch 8. A suction conduit 15 is communicated with a port 15*a* in the intake passage 3 downstream of the throttle valve 20 through a magnetic valve 25 and a suction conduit 15*b*. When a high suction pressure exists in the suction conduit 15, the diaphragm 13 is lowered to open the valve port 18. This results in closure of the vacuum switch 8, opening of the magnetic valve 10, and closure of the recirculation control valve 7.

Similarly, when the atmospheric pressure is low, the bellows 16 extends to lower the diaphragm 13, resulting in closing the vacuum switch 8 at a relatively lower vacuum intensity than the predetermined high vacuum intensity in the suction conduit 15. Accordingly, it will be understood that the vacuum switch 8 is closed at times of engine deceleration, and is also closed at the relatively lower vacuum intensity than the predetermined high vacuum intensity during the operation of engine deceleration when atmospheric pressure is low, either event resulting in interruption of recirculation of exhaust gas.

The construction and operation of the vacuum actuated air control valve 30 and the regulating valve 31 are described in detail in the copending application of Hiroyuki Nishimura Ser. No. 9,370 filed Feb. 5, 1979.

In accordance with a second aspect of the present invention, the feature described above is combined with the operation of the throttle opener 21 for the throttle valve 20 within the intake passage 3. The throttle opener control valve 22 controls the throttle opener 21. The construction and operation of the throttle opener control valve 22 are set forth in the copending application of Kawabata et al Ser. No. 144,325 filed Apr. 28, 1980. A suction conduit 23 is provided with a magnetic valve 25 which opens when the engine speed sensor 24 detects a speed higher than a predetermined speed, for example, a vehicle speed higher than 20 km/h. Thus, when the engine speed is decelerated during high-speed driving, high suction pressure causes the throttle valve 20 to be opened to a greater extent than that of the idling opening.

According to the present invention, the suction conduit 15 is connected to the magnetic valve 25 on the downstream side thereof. Thus, when the magnetic valve 25 is opened due to an engine speed higher than a predetermined speed, so that the throttle opener 21 is ready for operation, the vacuum switch 8 is also made ready for operation through the suction conduit 15.

The engine speed sensor 24 comprises a switch which closes when the engine speed exceeds a predetermined value. The actuating solenoid 26 of the magnetic valve 25 is connected to a battery or other power source 27 through the engine speed sensor switch 24. An ignition switch 28 is provided at the output side of the power source 27.

The operation of the exhaust gas recirculation system of the invention will now be described. According to the first aspect of the invention, the vacuum switch 8 closes under either of two conditions: (a) when a predetermined high suction pressure occurs within the intake passage 3 at the time of engine deceleration, and (b) when a relatively lower suction pressure than the predetermined high suction pressure occurs within the intake passage 3 at the time of engine deceleration under a low atmospheric pressure detected by the bellows 16. When either of these events occurs, the recirculation of exhaust gas ceases. The result is reduction in emission of pollutants during engine deceleration, and improvement in combustion when the atmospheric pressure decreases.

In the second aspect of the present invention, the magnetic valve 25 opens only when the engine speed is higher than expected, and causes the throttle opener 21 to be ready for operation. Thus, the recirculation of exhaust gas is controlled by the operation of the interlocked magnetic valve 25 and the vacuum switch 8.

The vacuum switch 8 is caused to operate simultaneously at the time of deceleration in engine speed or decrease in the atmospheric pressure, for control of exhaust gas recirculation. Accordingly, the system according to the present invention is relatively simple in construction and inexpensive as compared with any other system which carries out such operations separately. Further, according to the second aspect of the subject invention, the function of the system according to the first aspect is combined with the control for operation of the throttle opener. Similarly, this second aspect of the invention is more advantageous than a conventional system in which such two operations or functions are made separately.

Having fully described our invention, it is to be understood that we are not to be limited to the details herein set forth but that our invention is of the full scope of the appended claims.

We claim:

1. In combination with an internal combustion engine having an intake passage and an exhaust passage, and an exhaust gas return passageway having a recirculation control valve therein, the improvement comprising, in combination: a suction conduit, an actuator for said control valve responsive to vacuum pressure in said suction conduit, means including a magnetic valve for venting said suction conduit to atmosphere, atmospheric pressure compensation means, and means for operating said magnetic valve including a vacuum switch responsive to suction pressure in said intake passage modified by said atmospheric pressure compensation means.

2. For use with an internal combustion engine having an intake passage and an exhaust passage, the combination of: an exhaust gas return passageway having a recirculation control valve therein, a suction conduit, an actuator for said control valve responsive to vacuum pressure in said suction conduit, means including a magnetic valve for venting said suction conduit to atmosphere, atmospheric pressure compensation means, means for operating said magnetic valve including a vacuum switch responsive to suction pressure in said intake passage modified by said atmospheric pressure compensation means, and a second magnetic valve responsive to engine speed for opening said suction conduit.

3. In combination with an internal combustion engine having an intake passage and an exhaust passage, a throttle opener control device for moving a throttle valve in the intake passage under deceleration in engine speed, and an exhaust gas return passageway having a recirculation control valve therein, the improvement comprising, in combination: a throttle opener for moving a throttle valve, a first suction conduit connecting the throttle opener to the intake passage downstream of the throttle valve, a throttle opener control valve in said first suction conduit, a first magnetic valve responsive to engine speed for opening said first suction conduit when engine speed exceeds a predetermined value, a second suction conduit, an actuator for said recirculation control valve responsive to vacuum pressure in said second suction conduit, means including a second magnetic valve for opening said second suction conduit to atmosphere, and means for operating said second magnetic valve including a vacuum switch responsive to suction pressure in said first suction conduit downstream of said first magnetic valve, whereby the throttle opener operates to open the throttle valve beyond idling opening and simultaneously the recirculation of exhaust gas ceases when engine speed is decelerated from a relatively high engine speed.

* * * * *